US009529328B2

(12) United States Patent
Courvoisier

(10) Patent No.: US 9,529,328 B2
(45) Date of Patent: Dec. 27, 2016

(54) TIMEPIECE BRAKE WHEEL ASSEMBLY

(71) Applicant: ETA SA Manufacture Horlogere Suisse, Grenchen (CH)

(72) Inventor: Raphael Courvoisier, Corcelles (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/799,749

(22) Filed: Jul. 15, 2015

(65) Prior Publication Data

US 2016/0026154 A1 Jan. 28, 2016

(30) Foreign Application Priority Data

Jul. 24, 2014 (EP) ..... 14178403

(51) Int. Cl.

| | |
|---|---|
| ***G04B 29/00*** | (2006.01) |
| ***G04B 31/00*** | (2006.01) |
| ***G04B 35/00*** | (2006.01) |
| ***G04B 13/02*** | (2006.01) |
| ***G04B 19/02*** | (2006.01) |

(52) U.S. Cl.

CPC ..... *G04B 35/00* (2013.01); *G04B 13/02* (2013.01); *G04B 13/022* (2013.01); *G04B 13/023* (2013.01); *G04B 13/025* (2013.01); *G04B 19/02* (2013.01)

(58) Field of Classification Search

CPC ..... G04B 13/02; G04B 13/021; G04B 13/022; G04B 13/023; G04B 13/025; G04B 35/00

USPC ..... 368/141, 220–222, 322–326

See application file for complete search history.

(56) References Cited

U.S. PATENT DOCUMENTS 2,444,570 A * 7/1948 Lawrence et al. .... G06M 1/083 235/1 C
3,486,597 A * 12/1969 Carlton ..... F16D 41/12 192/46
4,358,166 A * 11/1982 Antoine ..... B60H 1/00857 384/215

(Continued)

FOREIGN PATENT DOCUMENTS

| | | | |
|---|---|---|---|
| CH | 701 075 B1 | 11/2010 | |
| FR | 2641351 A1 * | 7/1990 | ..... G04B 13/02 |
| JP | 58-153379 U | 10/1983 | |

OTHER PUBLICATIONS

European Search Report issued Jun. 22, 2015 in European Application 14178403, filed on Jul. 24, 2014 ( with English Translation).

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

Timepiece brake wheel assembly, including an arbor comprising a first surface cooperating, to guide pivoting, with a second surface of a wheel pivotally mounted on the arbor around a pivot axis, this second surface including one braking surface comprised in a brake shoe subjected to the action of a first spring, in one-piece with the wheel, and arranged to exert a radial force with respect to the pivot axis on the first surface, this assembly including notches forming a comb or a toothing, arranged to retain a finger-piece for discrete value adjustment of the friction exerted by the braking surface on the first surface, this assembly being arranged to be included in a timepiece mechanism or in a timepiece.

14 Claims, 3 Drawing Sheets

(56) References Cited

U.S. PATENT DOCUMENTS

| | | | | |
|---|---|---|---|---|
| 5,355,979 | A * | 10/1994 | Stephan | E05F 3/14 188/290 |
| 2006/0187768 | A1* | 8/2006 | Murazumi | G04B 13/026 368/324 |
| 2009/0154303 | A1* | 6/2009 | Vaucher | G04B 13/022 368/322 |
| 2009/0263182 | A1* | 10/2009 | Bannier | G04B 13/02 403/242 |
| 2012/0186054 | A1* | 7/2012 | Cusin | G04B 11/028 29/225 |
| 2013/0176829 | A1* | 7/2013 | Cusin | G04B 13/025 368/127 |
| 2014/0160901 | A1* | 6/2014 | Cusin | G04B 13/022 368/127 |
| 2014/0226447 | A1* | 8/2014 | Lagorgette | G04B 17/20 368/127 |
| 2014/0313869 | A1* | 10/2014 | Cattiau | G04B 37/0091 368/281 |
| 2015/0198927 | A1* | 7/2015 | Conus | G04B 18/006 368/171 |

* cited by examiner

TIMEPIECE BRAKE WHEEL ASSEMBLY

This application claims priority from European Patent Application No 14178403.3 filed Jul. 24, 2014, the entire disclosure of which is hereby incorporated herein by reference.

FIELD OF THE INVENTION

The invention concerns a timepiece brake wheel assembly including an arbor comprising a first surface cooperating, to guide pivoting, with a second surface of a wheel pivotally mounted on said arbor around a pivot axis, wherein said first surface or respectively said second surface includes at least one braking surface comprised in at least one brake shoe subjected to the action of at least a first elastic return means, in one piece with said arbor or respectively said wheel, and arranged to exert a radial force with respect to said pivot axis on said second surface or respectively said first surface.

The invention also concerns a timepiece mechanism including at least one such timepiece brake wheel assembly.

The invention also concerns a timepiece including at least one such timepiece brake wheel assembly.

The invention concerns the field of timepiece mechanisms, and more specifically gear trains.

BACKGROUND OF THE INVENTION

It is common, in horology, to have to use gear trains are not taut, in particular where additional modules or plates are used, for example for a small seconds display.

It is then known to brake at least one wheel, for example by the pressing force of a strip-spring pressing on the arbor or on the wheel of one of the gear train wheel sets. Such braking certainly prevents the visual perception of play in the gears by the user, but generates significant friction and wear. Indeed, the braking force is not constant from one movement to another, which often means it is necessary to use excessive braking force.

One alternative consists in braking of a magnetic nature, which is not always desirable in a timepiece movement.

The use of flexible toothings is an elegant solution, where braking occurs on the toothings, but it is expensive.

SUMMARY OF THE INVENTION

The invention proposes to address the problem of angular play in a gear train, in particular a non-taut gear train, through the use of friction.

To this end, the invention concerns a timepiece brake wheel assembly, including an arbor comprising a first surface cooperating, to guide pivoting, with a second surface of a wheel pivotally mounted on said arbor around a pivot axis, wherein said first surface or respectively said second surface includes at least one braking surface comprised in at least a first arm subjected to the action of at least a first elastic return means, in one-piece with said arbor or respectively said wheel, and arranged to exert a radial force with respect to said pivot axis on said second surface or respectively said first surface, characterized in that said brake wheel assembly includes built-in means for discrete value adjustment of the friction exerted by said braking surface on said second surface or respectively said first surface.

According to a feature of the invention, said first surface or respectively said second surface includes, distinct from each other, on the one hand at least one guide surface having predetermined play, about a pivot axis of said second or respectively said first surface, and on the other hand at least one said braking surface.

The invention also concerns a timepiece mechanism including at least one such timepiece brake wheel assembly.

The invention also concerns a timepiece including at least one such timepiece brake wheel assembly.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
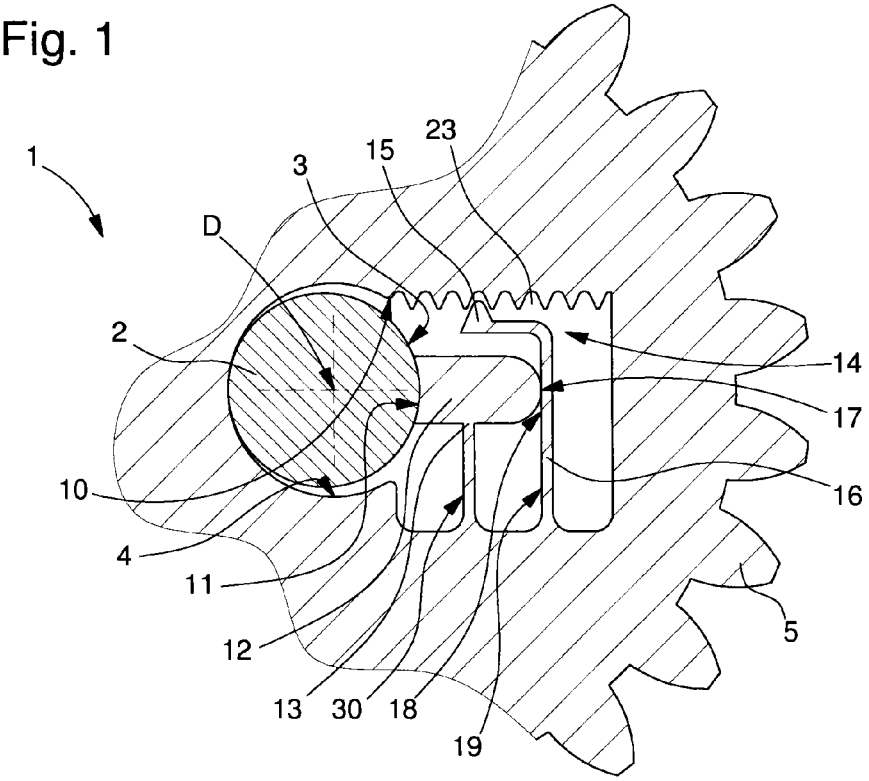
FIG. 1 shows a schematic cross-section, through a plane perpendicular to the pivot axis, of a brake wheel assembly according to a first embodiment of the invention, wherein it is formed of an arbor on which pivots a wheel that cooperates therewith, on the one hand by means of a guide surface, and on the other hand by means of a braking surface exerting on the arbor a centripetal radial force, under the action of elastic return means exerting friction that is adjustable under the action of means for discrete value adjustment.

The invention concerns the field of timepiece gear trains.

The invention concerns a timepiece brake wheel assembly 1, including an arbor 2 and a wheel 5 pivotally mounted on said arbor 2, around a pivot axis D.

Arbor 2 includes a first surface 3, which cooperates, to guide pivoting, with a second surface 4 of wheel 5.

The first surface 3 or respectively second surface 4 includes at least one braking surface 11 carried by at least a first braking arm 30 subjected to the action of at least a first elastic return means 13. This first elastic return means 13 is preferably in one-piece with arbor 2 or respectively wheel 5, and is arranged to exert a radial force with respect to pivot axis D on second surface 4 or respectively first surface 3.

The first elastic return means 13 is advantageously a flexible strip, more flexible than the brake shoe 12 which is mounted in a cantilever manner at a distal end of said strip, like a hammer head on its shaft, the end of the flexible strip opposite the brake shoe being embedded in the corresponding structure, here the structure of wheel 5 in the cases illustrated by FIGS. 1 to 4.

According to the invention, this assembly 1 includes built-in means 14 for discrete value adjustment of the friction exerted by braking surface 11 on second surface 4 or respectively first surface 3.

It is thus understood that friction can theoretically be ensured both by a component of wheel 5 pressing on a continuous surface of the arbor and vice versa. The invention is more specifically illustrated in the configuration where a component of wheel 5 exerts friction on a continuous surface of the arbor due to ease of implementation, and also the advantage provided by utilisation of an arbor of small dimensions and very simple geometry, which can then advantageously be produced from a very hard material such as ruby, ceramic, carbide, high-speed steel, or suchlike.

According to a particular feature of the invention, as seen in FIGS. 1 to 4, the first surface 3 or respectively second surface 4 includes, distinct from each other, on the one hand, at least one guide surface 10 having a predetermined play J, about a pivot axis D, of second surface 4 or respectively first surface 3, and on the other hand, at least one such braking surface 11, comprised in at least one brake shoe 12 at the distal end of a first arm 30 subjected to the action of at least a first elastic return means 13. This first elastic return means 13 is preferably in one-piece with arbor 2 or respectively wheel 5, and is arranged to exert a radial force with respect to pivot axis D on second surface 4 or respectively first surface 3.

In the illustrated embodiments, which are not limiting, these built-in adjustment means 14 include at least one bearing surface 18, which is arranged to cooperate in abutment and by thrust force with a complementary bearing surface 17 comprised in brake shoe 12 on the side opposite braking surface 11.

Figure 2:
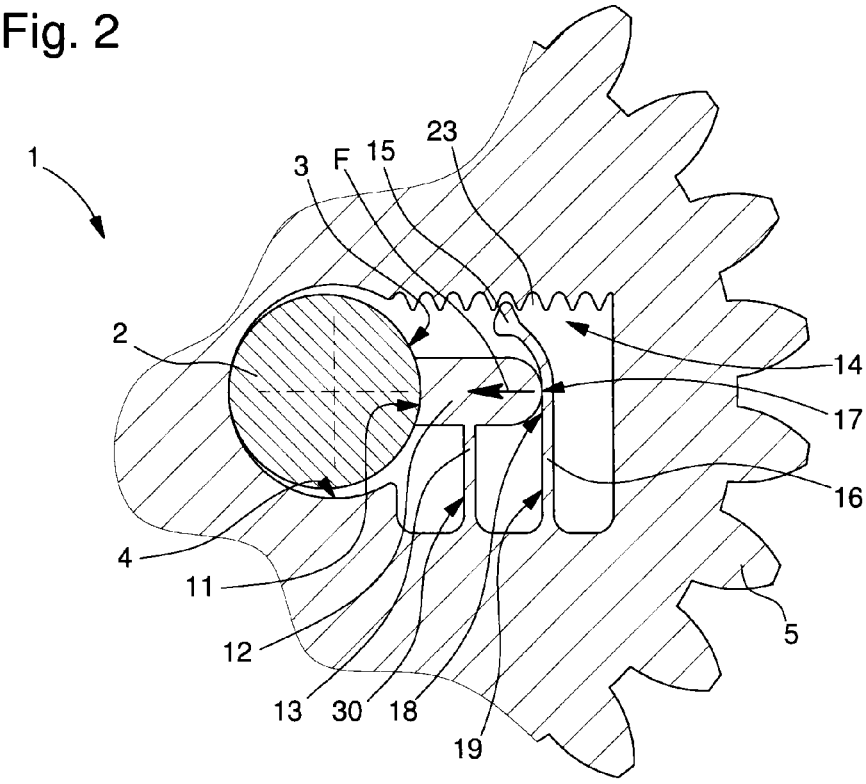
FIG. 2 shows, in a similar manner to FIG. 1, a variant of this first embodiment.
Figure 3:
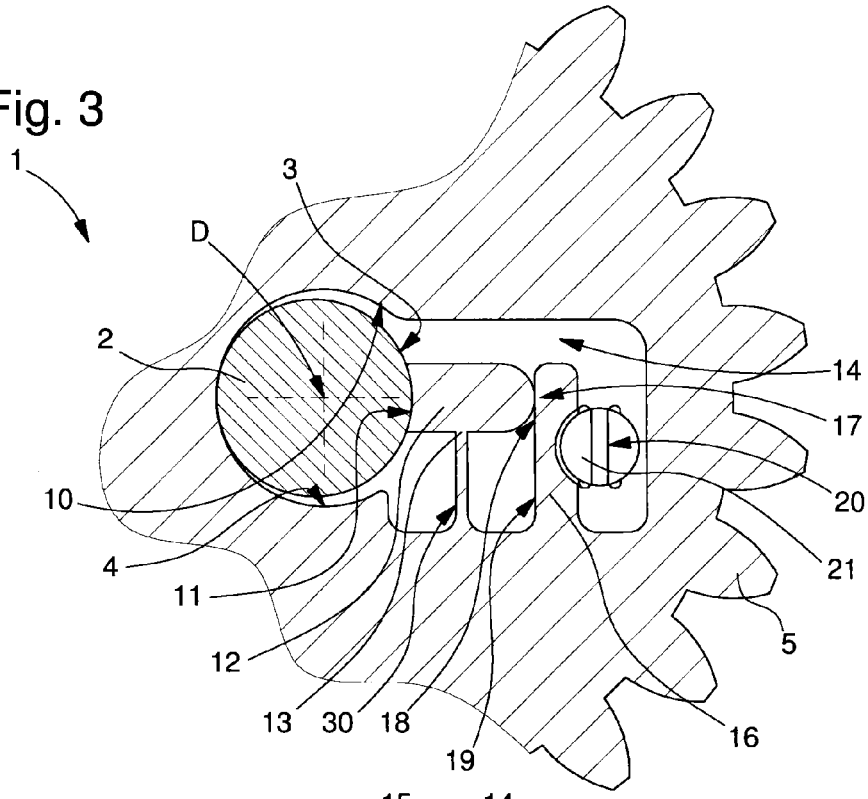
FIG. 3 shows, in a similar manner to FIG. 1, a second embodiment.

FIGS. 1 to 3 show, in particular, built-in adjustment means 14 which include at least a second flexible arm 19, carrying such a bearing surface 18.

This second arm 19 is either, on a one hand as in FIG. 3, radially limited on a first side with respect to pivot axis D, on a second side opposite to said first side, in abutment on an adjustment device 20 arranged to occupy one among a plurality of discrete positions with respect to arbor 2 (or respectively to wheel 5), or, in the other hand as in FIGS. 1 and 2, returned towards complementary bearing surface 17 of brake shoe 12 by a second elastic return means 16.

FIGS. 1 and 2 illustrate a brake wheel assembly 1 wherein second arm 19 is returned towards complementary bearing surface 17 of brake shoe 12 by second elastic return means 16. This second arm 19 includes at least one finger-piece 15 (or respectively a notch) subjected to the return action of the second elastic return means 16 and arranged to cooperate with one notch at time from a plurality of notches 23 comprised in arbor 2 or respectively wheel 5, in the case of the Figures, each said notch 23 corresponding to a different friction adjustment value. FIGS. 1 and 2 show a series of notches 23 similar to a comb or to a toothing, arranged to retain finger-piece 15 in position after operation.

The second elastic return means 16 is advantageously a flexible strip, more flexible than finger-piece 15, which is mounted in a cantilever manner at a distal end of the strip, like a hammer head on its shaft, the end of the flexible strip opposite to the finger-piece being embedded in the corresponding structure, here the structure of wheel 5 in the cases illustrated by the Figures.

In one advantageous embodiment, brake shoe 12 is subjected both to the action of at least a first elastic return means 13 and to the action of second elastic return means 16.

Second elastic return means 16 may form a simple end-of-travel stop for brake shoe 12, whose complementary bearing surface 17 then simply abuts on bearing surface 18 of second arm 19, as seen in FIG. 1: in this case, the second elastic return means 16 is essentially used for friction adjustment, by allowing the movement of finger-piece 15 and enabling cooperation thereof with a notch 23 selected for a specific friction value.

FIG. 2 shows that second elastic return means 16 can also be utilised to contribute to friction by exerting a centripetal radial force F on brake shoe 12. Preferably, the torque exerted on brake shoe 12 by first elastic return means 13 is greater than that exerted by second elastic return means 16.

Advantageously, second elastic return means 16 is in one-piece with arbor 2 or respectively wheel 5 (with wheel 5 in the case of the Figures).

In the variant of FIG. 3, second arm 19 is radially limited with respect to pivot axis D, opposite thereto, in abutment on an adjustment device 20, which includes an eccentric setting in discrete positions, for example through the use of an eccentric 21 pivoting on wheel 5, on which it can be stopped in different angular positions, using notches or suchlike.

Figure 4:
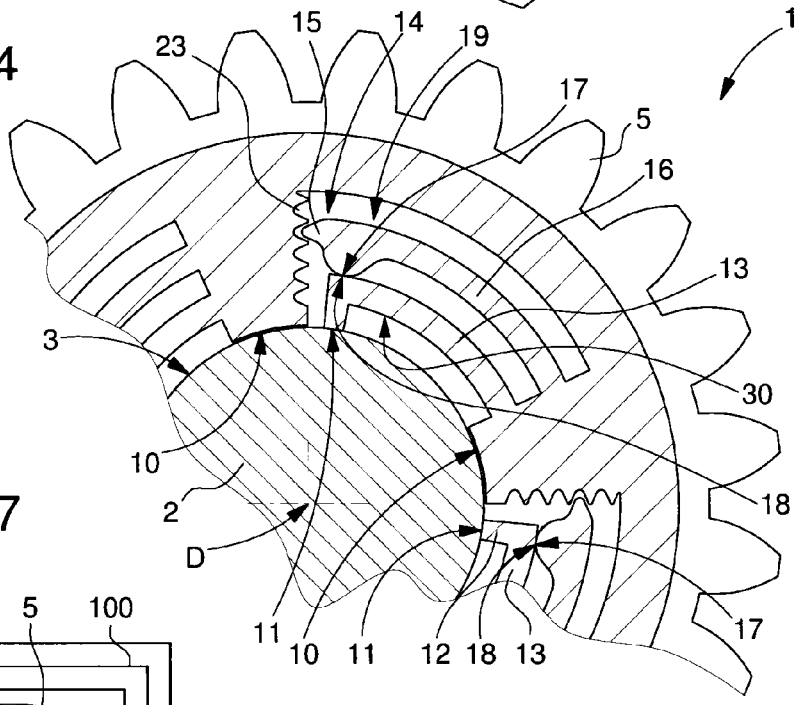
FIG. 4 shows, in a similar manner to FIG. 1, a third embodiment, with a plurality of curved arms substantially concentric to the arbor.
Figure 7:
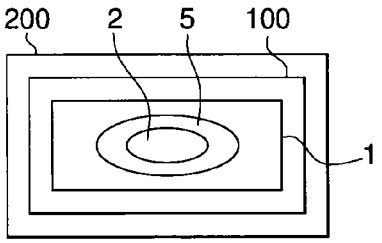
FIG. 7 shows block diagrams of a timepiece comprising a mechanism which includes a one such brake wheel assembly.

The shapes of the elastic return arms, brake shoes, arms and notches may be very diverse. FIG. 4 thus illustrates a third embodiment, with a plurality of arms and bent strips substantially concentric to arbor 2.

Figure 5:
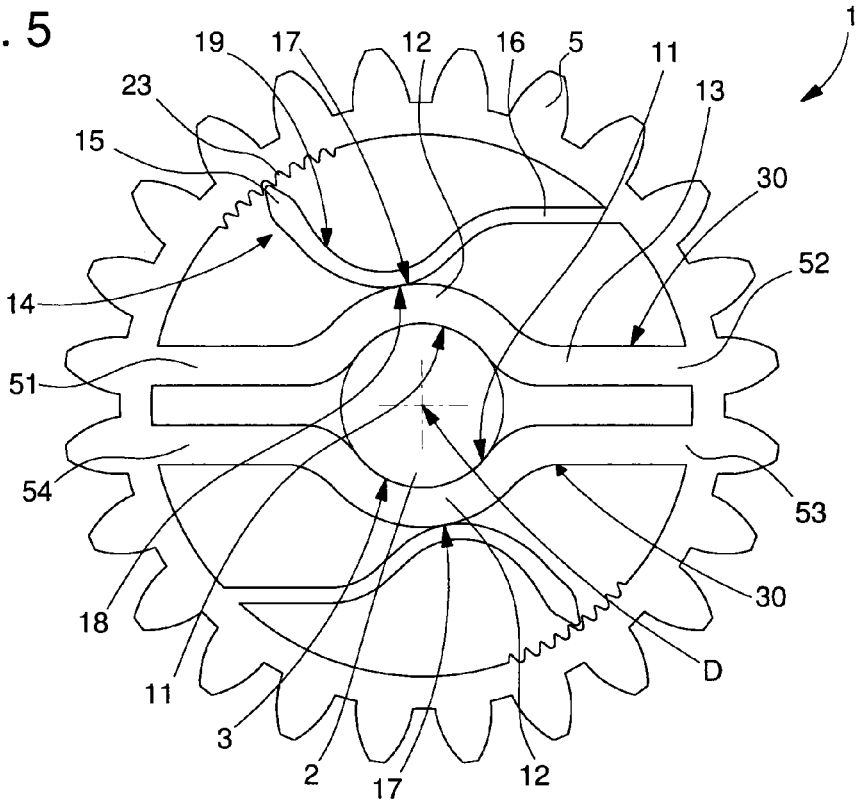
FIG. 5 shows, in a similar manner to FIG. 1, but not in cross-section, a fourth embodiment, with two arms taut on the rim of the wheel and clamping the arbor, each of these arms being subjected to a centripetal radial thrust force exerted by second elastic return means incorporated in the wheel.

FIG. 5 illustrates a fourth embodiment, with two arms 30, which are not in a cantilever arrangement like those of FIGS. 1 to 4, but held taut on the rim of wheel 5 between points of attachment 51, 52, 53, 54 and together clamp arbor 2, each of these arms 30 being subjected to a centripetal radial thrust force exerted by second elastic return means 16 incorporated in wheel 5. Arbor 2 is then guided by two braking surfaces 11, and there is no surface reserved for guiding like the guide surfaces 4 of the other embodiments. The arrangement of built-in adjustment means 14 is similar to that of the other embodiments presented above. Naturally, this variant can be provided with a greater number of arms.

Figure 6:
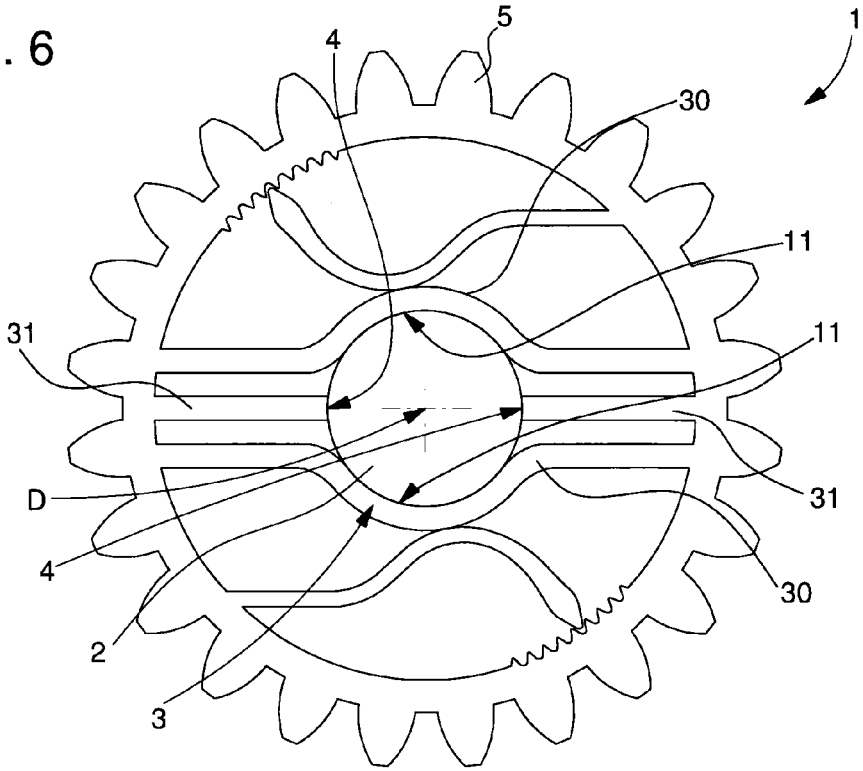
FIG. 6 shows, in a similar manner to FIG. 5, a fifth embodiment, which also includes, on the wheel, fixed guide surfaces for the arbor, independent of the braking surfaces.

It is also possible to envisage combining this fourth embodiment with fixed guide surfaces 4, independent of braking surfaces 11 and carried by fixed arms 31, as seen in a fifth embodiment in FIG. 6.

Naturally, assembly 1 according to the invention may include a plurality of braking surfaces 11, notably evenly distributed around pivot axis D.

In an advantageous embodiment, since it is non-magnetic, wheel 5 is made of single crystal or polycrystalline silicon, or of a similar material implemented in a photolithography method or "MEMS" or "LIGA" or similar process.

In an advantageous embodiment, arbor 2 is made of ruby.

Preferably, brake wheel assembly 1 according to the invention is formed exclusively of two components which are arbor 2 and wheel 5. Arbor 2 and wheel 5 are each a one-piece component including all the necessary bearing surfaces, and the required return and position holding means.

Advantageously, arbor 2 is fixedly mounted on a main plate or a bridge comprised in a mechanism 100 or a timepiece movement in which the brake wheel assembly 1 concerned is integrated.

The invention also concerns a timepiece mechanism 100, notably a movement, including at least one such brake wheel assembly 1.

The invention also concerns a timepiece 200 including at least one such timepiece brake wheel assembly 1.

In summary, the brake actuation adjustment hereby obtained makes it possible to modify the friction force (or torque) exerted on the arbor, in a reproducible manner, which facilitates and accelerates adjustments.

The invention makes it possible to reduce the number of components with respect to a conventional mechanism, to reduce play in the gears (which can always be seen on the display hands), which leads to improved reliability, and a reduction in costs, especially where manufacture by cutting is envisaged.

The invention makes it possible to reduce wear with respect to conventional spring braking systems.

What is claimed is:

1. A timepiece brake wheel assembly, comprising:

an arbor comprising a first surface cooperating, to guide pivoting, with a second surface of a wheel pivotally mounted on said arbor around a pivot axis, wherein said first surface or respectively said second surface includes at least one braking surface carried by at least a first braking arm subjected to the action of at least a first elastic return means, in one-piece with said arbor or respectively said wheel, and arranged to exert a radial force with respect to said pivot axis on said second surface or respectively said first surface, wherein said brake wheel assembly includes built-in adjustment means for discrete value adjustment of friction exerted by said braking surface on said second surface or respectively said first surface, wherein said built-in adjustment means include a bearing surface arranged to cooperate in abutment and by thrust force with a complementary bearing surface comprised in a brake shoe on a side opposite said braking surface, and wherein said built-in adjustment means include at least a second flexible arm carrying said bearing surface, said second arm being, either radially limited on a first side with respect to said pivot axis and, on a second side opposite to said first side, in abutment on an adjustment device arranged to occupy one of a plurality of discrete positions with respect to said arbor or respectively said wheel, or returned towards said complementary bearing surface of said brake shoe by a second elastic return means.

2. The timepiece brake wheel assembly according to claim 1, wherein said first surface or respectively said second surface includes, distinct from each other, at least one guide surface having predetermined play, about a pivot axis of said second surface or respectively said first surface, and at least one said braking surface.

3. The brake wheel assembly according to claim 1, wherein said second arm is returned towards said complementary bearing surface of said brake shoe by said second elastic return means, and includes at least one finger-piece, or respectively one notch, subjected to the return action of said second elastic return means and arranged to cooperate with only one notch at a time of a plurality of notches comprised in said arbor or respectively said wheel, each notch of said plurality of notches corresponding to a different friction adjustment value.

4. The brake wheel assembly according to claim 3, wherein said brake shoe is subjected both to the action of at least a first elastic return means and to the action of said second elastic return means.

5. The brake wheel assembly according to claim 1, wherein said second elastic return means is in one-piece with said arbor or respectively said wheel.

6. The brake wheel assembly according to claim 1, wherein torque exerted on said brake shoe by said first elastic return means is greater than torque exerted by said second elastic return means.

7. The brake wheel assembly according to claim 1, wherein said second arm is radially limited with respect to said pivot axis opposite thereto in abutment on said adjustment device which includes an eccentric adjustment in discrete positions.

8. The brake wheel assembly according to claim 1, wherein said wheel is made of single crystal or polycrystalline silicon.

9. The brake wheel assembly according to claim 1, wherein said arbor is made of ruby.

10. The brake wheel assembly according to claim 1, wherein the assembly comprises only two components which are said arbor and said wheel.

11. The brake wheel assembly according to claim 1, wherein said arbor is fixedly mounted on a main plate or a bridge comprised in a timepiece mechanism or movement in which said brake wheel assembly is integrated.

12. A timepiece mechanism comprising:

at least one brake wheel assembly according to claim 1.

13. A timepiece comprising:

at least one brake wheel assembly according to claim 1.

14. A timepiece brake wheel assembly, comprising:

an arbor comprising a first surface cooperating, to guide pivoting, with a second surface of a wheel pivotally mounted on said arbor around a pivot axis, wherein said first surface or respectively said second surface includes at least one braking surface carried by at least a first braking arm subjected to the action of at least a first elastic return, in one-piece with said arbor or respectively said wheel, and arranged to exert a radial force with respect to said pivot axis on said second surface or respectively said first surface, wherein said brake wheel assembly includes a bearing surface arranged to cooperate in abutment and by thrust force with a complementary bearing surface comprised in a brake shoe on a side opposite said braking surface to adjust, by a discrete value, friction exerted by said braking surface on said second surface or respectively said first surface, and wherein said assembly includes a second flexible arm carrying said bearing surface, said second arm being either radially limited on a first side with respect to said pivot axis and, on a second side opposite to said first side, in abutment on an adjustment device arranged to occupy one of a plurality of discrete positions with respect to said arbor or respectively said wheel, or returned towards said complementary bearing surface of said brake shoe by a second elastic return.

* * * * *